US010006249B2

(12) United States Patent
Parkin

(10) Patent No.: US 10,006,249 B2
(45) Date of Patent: Jun. 26, 2018

(54) INVERTED WELLBORE DRILLING MOTOR

(71) Applicant: Schlumberger Technology Corporation, Sugar land, TX (US)

(72) Inventor: Edward Parkin, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 348 days.

(21) Appl. No.: 14/805,423

(22) Filed: Jul. 21, 2015

(65) Prior Publication Data

US 2016/0024846 A1 Jan. 28, 2016

Related U.S. Application Data

(60) Provisional application No. 62/028,770, filed on Jul. 24, 2014.

(51) Int. Cl.

| | |
|---|---|
| ***E21B 4/02*** | (2006.01) |
| ***E21B 4/20*** | (2006.01) |
| ***E21B 7/06*** | (2006.01) |
| ***E21B 4/00*** | (2006.01) |

(52) U.S. Cl.

CPC ..... *E21B 4/20* (2013.01); *E21B 4/003* (2013.01); *E21B 4/02* (2013.01); *E21B 7/068* (2013.01)

(58) Field of Classification Search

CPC ..... E21B 4/02; E21B 4/20; E21B 7/068

See application file for complete search history.

(56) References Cited

U.S. PATENT DOCUMENTS

| | | | | |
|---|---|---|---|---|
| 2,944,792 | A * | 7/1960 | Gros | E21B 4/02 175/107 |
| 5,113,953 | A | 5/1992 | Noble | |
| 5,265,682 | A | 11/1993 | Russell et al. | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,901,085 | A | 10/1999 | Colebrook | |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |

(Continued)

*Primary Examiner* — Robert E Fuller
*Assistant Examiner* — Steven A MacDonald

(57) ABSTRACT

An inverted drill motor according to one or more embodiments includes an outer housing rotatable about an internal shaft member whereby rotational speed is imparted to the outer housing in response to fluid flow between the outer housing and the internal shaft member, the outer housing to connect to a drill bit and a top drive shaft portion of the internal shaft member having a top end to connect to the drill string whereby the internal shaft member and the drill string rotate at the same speed. The inverted drill motor may be for example an inverted positive displacement motor or inverted turbodrill.

16 Claims, 5 Drawing Sheets

(56) References Cited

U.S. PATENT DOCUMENTS

| | | | | |
|---|---|---|---|---|
| 6,364,034 | B1 | 4/2002 | Schoeffler | |
| 6,394,193 | B1 | 5/2002 | Askew | |
| 6,920,946 | B2 * | 7/2005 | Oglesby | E21B 4/003 166/66.4 |
| 7,055,629 | B2 * | 6/2006 | Oglesby | E21B 4/003 175/106 |
| 7,188,685 | B2 | 3/2007 | Downton et al. | |
| 8,763,725 | B2 | 7/2014 | Downton | |
| 9,366,087 | B2 * | 6/2016 | Sugiura | E21B 7/067 |
| 2001/0052438 | A1 | 12/2001 | Lorronde et al. | |
| 2002/0011359 | A1 | 1/2002 | Webb et al. | |
| 2003/0056990 | A1 * | 3/2003 | Oglesby | E21B 4/003 175/57 |
| 2005/0189146 | A1 * | 9/2005 | Oglesby | E21B 4/003 175/107 |
| 2012/0118646 | A1 * | 5/2012 | Russell | E21B 4/02 175/73 |

* cited by examiner

INVERTED WELLBORE DRILLING MOTOR

BACKGROUND

This section provides background information to facilitate a better understanding of the various aspects of the disclosure. It should be understood that the statements in this section of this document are to be read in this light, and not as admissions of prior art.

Positive displacement motors (PDMs) are known in the art and are commonly used to drill wells in earth formations. Positive displacement motors traditionally have a power section, transmission section, and a bearing section in that order from the top connected to the drill string to the bottom connected to the drill bit. PDMs operate according to a reverse mechanical application of the Moineau principle wherein pressurized fluid is forced through a series of channels formed on a rotor and a stator in the power section. The channels are generally helical in shape and may extend the entire length of the rotor and stator. The passage of the pressurized fluid generally causes the rotor to rotate within the stator. The rotor is disposed through the stator and is connected to the drilling bit through a transmission shaft and a drive shaft to increase the rotational speed of the drill bit. The stator is connected with the drill collar which is connected to the drilling string. The drive shaft rotates at the higher speed of the drill bit and can suffer fatigue failures due to the high number of cycles it sees.

Turbine powered drill motors, known as turbodrills, utilize turbines to convert hydraulic power of the drilling fluid into mechanical rotation of an internal drive shaft which is connected to drill bit. The internal drive shaft rotates at a higher speed than the outer housing and the drill string.

SUMMARY

An inverted drill motor according to one or more embodiments includes an outer housing rotatable about an internal shaft member whereby rotational speed is imparted to the outer housing in response to fluid flow between the outer housing and the internal shaft member, the outer housing to connect to a drill bit and a top drive shaft portion of the internal shaft member having a top end to connect to the drill string whereby the internal shaft member and the drill string rotate at the same speed. The inverted drill motor may be for example an inverted positive displacement motor or inverted turbodrill. An example of a bottom hole assembly (BHA) includes an upper BHA including a drill string. a lower BHA including a drill bit and an inverted drill motor having an internal shaft member connected to the upper BHA to rotate in unison with the drill string at a surface rotational speed and an outer housing connected at a bottom end to the lower BHA to rotate in unison with the drill bit at a drill bit rotational speed, the inverted drill motor imparting rotational speed to the drill bit.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
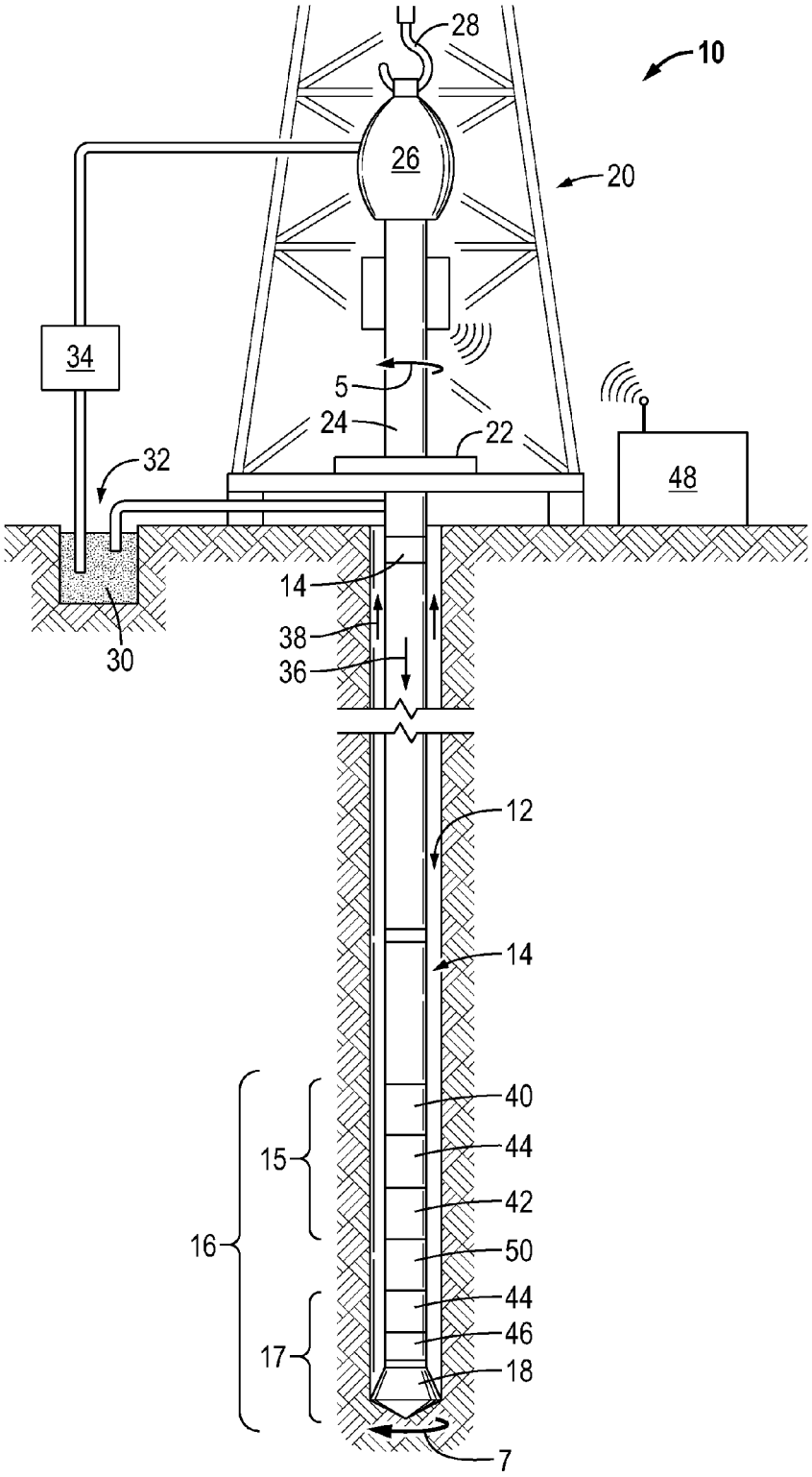
FIG. 1 is illustrates a well and drilling system incorporating an inverted positive displacement motor according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface from which drilling operations are initiated.

FIG. 1 illustrates a well system 10 incorporating an inverted drill motor 50 such as an inverted positive displacement motor (PDM) or an inverted turbodrill. The well site can be onshore or offshore. A wellbore or borehole 12 is formed in subsurface formations by rotary drilling. The borehole may include vertical sections relative to the surface and angled or deviated sections.

A drill string 14 having a bottom hole assembly (BHA) 16 which includes a drill bit 18 at its lower end is suspended within borehole 12. The drill string may be formed for example of interconnected segments, i.e., pipe joints, or may be for example coil tubing. The surface assembly or system 20 includes a platform and derrick assembly, i.e., drilling rig, positioned over the borehole 12, the illustrated surface system 20 includes a rotary table 22, kelly 24, hook 26 and rotary swivel 28. The drill string 14 is rotated by the rotary table 22, which engages the kelly 24 at the upper end of the drill string 14. The drill string 14 is suspended from a hook 26, attached to a traveling block through the kelly 24 and a rotary swivel 28 which permits rotation of the drill string 14 relative to the hook. As is well known, a top drive system could alternatively be used. The surface system 20 imparts a rotational speed to drill string 14, referred to generally as the surface rotational speed or surface revolutions per minute (RPM) 5.

The drilling system includes drilling fluid or mud 30 stored in a tank or pit 32 formed at the well site. A pump 34 delivers the drilling fluid 30 to the interior of the drill string 14, for example via a port in the swivel 28, causing the drilling fluid to flow downward through the drill string 14 as indicated by the directional arrow 36. The drilling fluid exits the drill string 14 via ports in the drill bit 18, and then circulates upwardly through the annulus region between the outside of the drill string 14 and the wall of the borehole, as indicated by the directional arrows 38. Circulation of the drilling fluid lubricates the drill bit 18 and carries formation cuttings up to the surface as it is returned to the pit 32 for recirculation. Circulation of the drilling fluid can further be utilized to drive the inverted drill motor 50.

The illustrated bottom hole assembly 16 includes a logging-while-drilling (LWD) module 40, a measuring-while-drilling (MWD) module 42, stabilizers 44, inverted drill motor 50, and a drill bit 18. The inverted drill motor 50 is connected at a top end 62 to the upper BHA 15 and drill string 14 and the lower or bottom end of the inverted drill motor 50 is connected to the lower BHA 17 and drill bit 18. The inverted drill motor 50 can be utilized for example to rotate the drill bit at a bit rotational speed, or bit revolutions per minute (RPM) 7 that is greater than the surface rotational speed 5. As will be understood by those skilled in the art with benefit of this disclosure the surface rotational speed may be zero.

BHA 16 in FIG. 1 also includes a rotary steerable system (RSS) indicated by the rotary steering device 46. Rotary steerable systems are used to control the direction and inclination of the borehole by exerting aside forces on the drill bit and/or the drill collars, or by pointing the drill bit in a particular direction. Steering device 46 is illustrated at a position below the inverted drill motor 50; however, the RSS device may be located in other locations as well. As will be understood by those skilled in the art with benefit of the disclosure the BHA may be configured without an RSS. Data and control signals may be communicated between the surface, e.g. surface controller 48, and the BHA via wired or wireless communications. Subsurface or downhole controllers may be located for example in the MWD module and or the steering device 46. In accordance to some embodiments, signals can be communicated between the surface controller and the MWD module and between the MWD module and the steering assembly for example via wires or short-hop telemetry.

The LWD module 40 is housed in a special type of drill collar, as is known in the art, and can contain one or a plurality of known types of logging tools. It will also be understood that more than one LWD and/or MWD module can be employed. The LWD module includes capabilities for measuring, processing, and storing information, as well as for communicating with the surface equipment.

The MWD module 42 is also housed in a special type of drill collar, as is known in the art, and can contain one or more devices for measuring characteristics of the drill string 14 and drill bit 18. The MWD tool may include an apparatus for generating electrical power to the downhole system. This may include for example a mud turbine generator powered by the flow of the drilling fluid, it being understood that other power and/or battery systems may be employed. The MWD module includes for example one or more of the following types of measuring devices: a weight-on-bit measuring device, a torque measuring device, a vibration measuring device, a shock measuring device, a stick slip measuring device, a direction measuring device, and an inclination measuring device.

The inverted drill motor 50 may be utilized in particular for controlled steering in directional drilling. Directional drilling is the intentional deviation of the wellbore from the path it would naturally take. In other words, directional drilling is the steering of the drill string 14 so that it travels in a desired direction. A directional drilling system may also be used in vertical drilling operations as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course. Rotary steerable systems, or steering systems, may be generally classified as point-the-bit, push-the-bit, or hybrid systems.

In point-the-bit system, the axis of rotation of the drill bit is deviated from the local axis of the bottom hole assembly in the general direction of the desired path (target attitude). The borehole is propagated in accordance with the customary three-point geometry defined by upper and lower stabilizer touch points and the drill bit touch point. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the drill bit axis from the local bottom hole assembly axis; instead, the requisite non-collinear condition is achieved by causing either or both of the upper or lower stabilizers to apply an eccentric force or displacement in a direction that is preferentially orientated with respect to the direction of the borehole propagation. Again, there are many ways in which this may be achieved, including non-rotating (with respect to the hole) eccentric stabilizers (displacement based approaches) and eccentric actuators that apply force to the drill bit in the desired steering direction, e.g. by extending steering actuators into contact with the surface of the borehole. Again, steering is achieved by creating non co-linearity between the drill bit and at least two other touch points. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

The steerable system may be of a hybrid type, for example having a rotatable collar, a sleeve mounted on the collar so as to rotate with the collar, and a universal joint permitting angular movement of the sleeve relative to the collar to allow tilting of the axis of the sleeve relative to that of the collar. Actuators control the relative angles of the axes of the sleeve and the collar. By appropriate control of the actuators, the sleeve can be held in substantially a desired orientation while the collar rotates. Non-limiting examples of hybrid systems are disclosed for example in U.S. Pat. Nos. 8,763,725 and 7,188,685.

Figure 2:
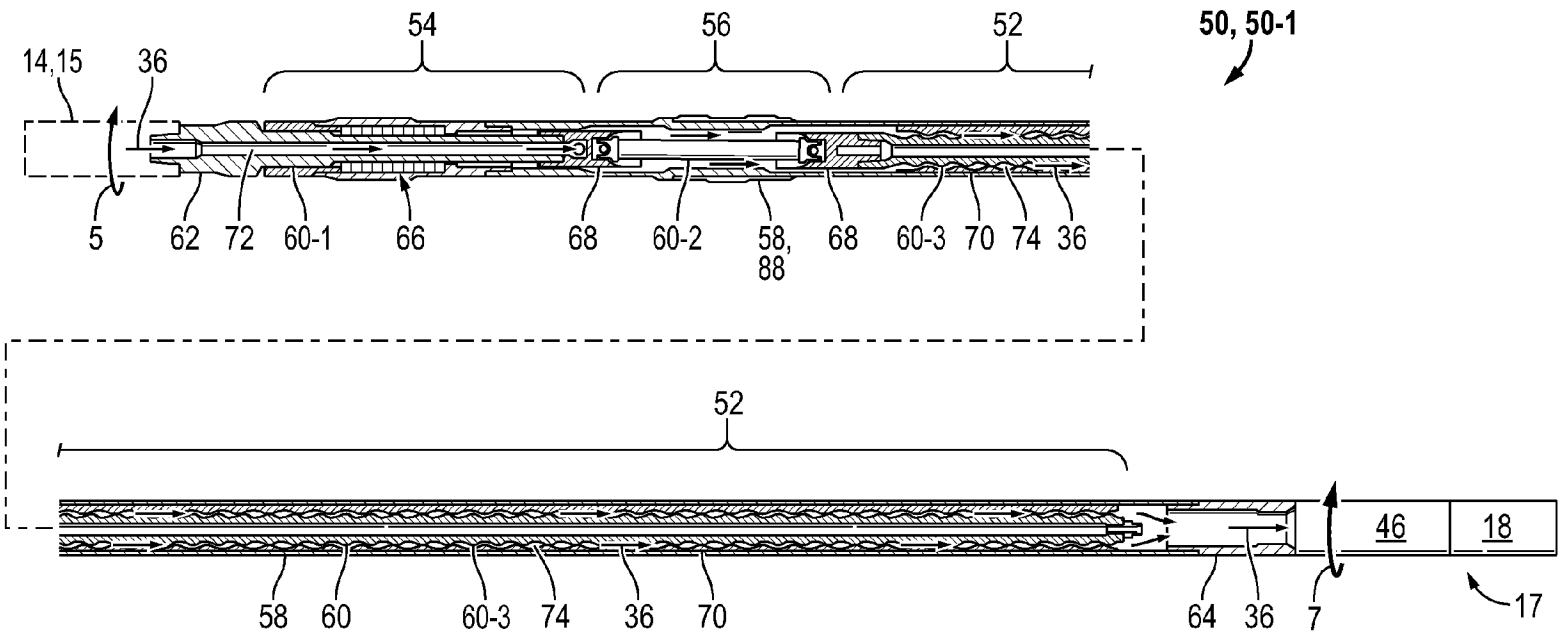
FIG. 2 illustrates an inverted drill motor in the form of an inverted positive displacement motor according to one or more aspects of the disclosure.
Figure 3:
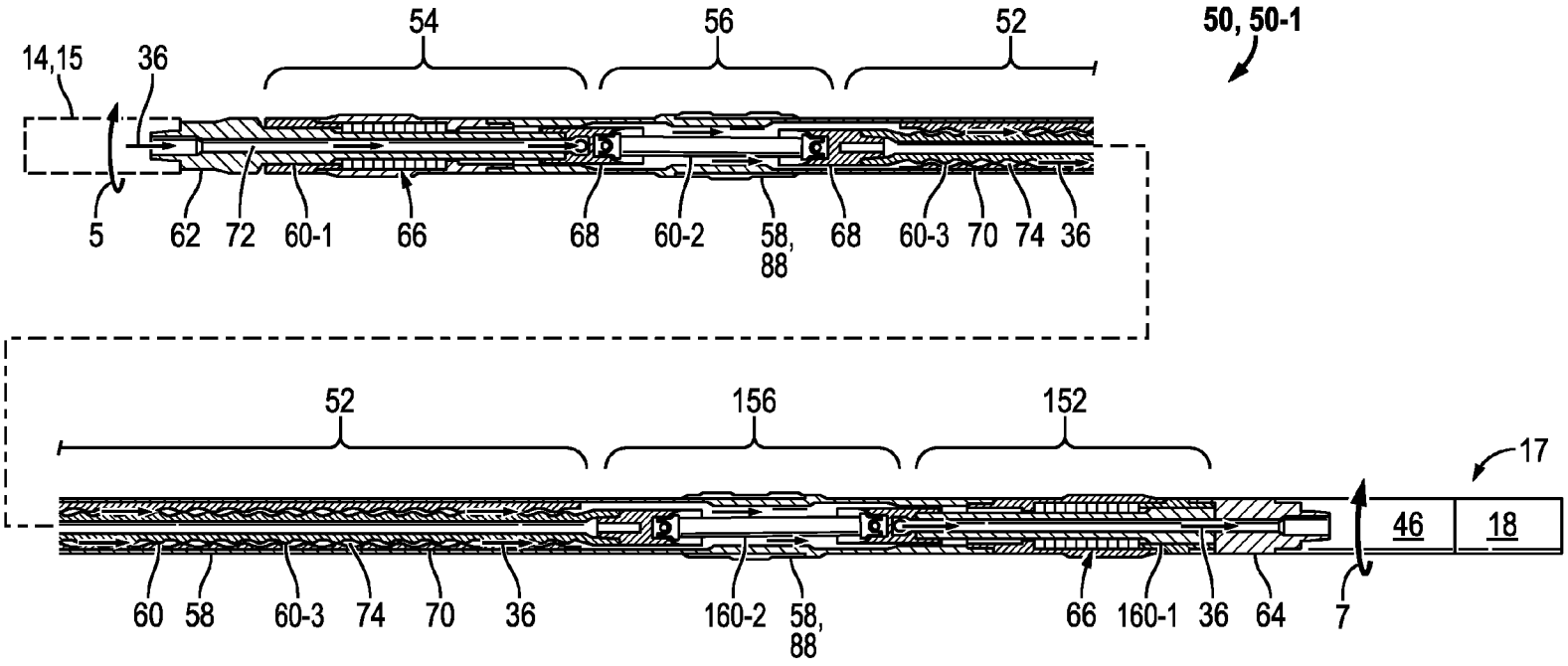
FIG. 3 illustrates an inverted drill motor in the form of an inverted positive displacement motor having a power section connected between upper bearing and transmission sections and lower bearing and transmission sections according to one or more aspects of the disclosure.
Figure 4:
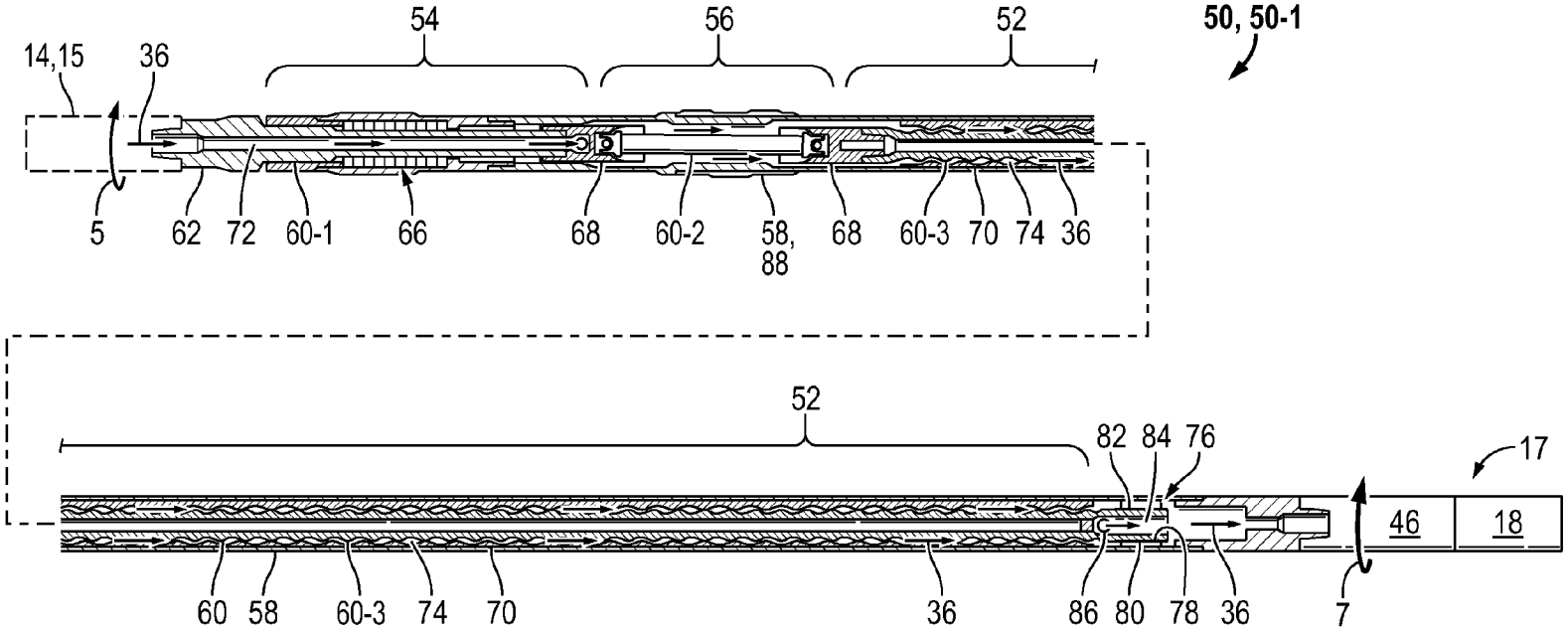
FIG. 4 illustrates an inverted drill motor in the form of an inverted positive displacement motor incorporating a radially compliant axial bearing at the bottom end of the power section according to one or more aspects of the disclosure.

FIGS. 2 to 4 illustrate an inverted drill motor 50 in the form of an inverted positive displacement motor (PDM) 50-1 having a power section 52 connectable to the upper BHA 15 or drill string 14 through a bearing section 54 and a transmission section 56. As will be understood by those skilled in the art with benefit of the disclosure, reference to connected to the upper BHA 15 includes being directly connected to the tubular forming the drill string 14, for example drill pipe, as well as being connected to a particular collar, i.e. tool or module, that is specifically or generally referred to as a bottom hole assembly member. The inverted drill motors have an outer housing 58, i.e., collar, which can rotate relative to an internal shaft member 60.

Bearing section 54 a includes a top or initial end 62 of the internal shaft member 60 and in use is connected to the upper BHA 15 so that the internal shaft member 60 rotates with the drill string 14 at the surface rotational speed 5. The outer housing 58 comprises a bottom end 64 that is connected to the drill bit 18 such that in operation the power section 52 rotates the outer housing 58 relative to the internal shaft member 60 thereby imparting applying a bit rotational speed 7 to the drill bit 18 that is greater than the surface rotational speed 5. As illustrated by example in the figures, one or more sections, devices, and tools, may be located between power section 52 and the drill bit 18.

The internal shaft member 60 of inverted PDM 50-1 includes a top drive shaft section or portion 60-1 connected by a transmission shaft 60-2, e.g., flex shaft, to a power shaft section or portion 60-3. Top drive shaft portion 60-1 of the internal shaft member 60 is rotatably mounted or secured in the outer housing 58 by bearings 66 in the bearing section 54. The illustrated transmission shaft 60-2 is connected to the top drive shaft portion 60-1 and the power shaft portion 60-3 by universal joints 68.

Power section 52 of the inverted PDM 50-1 includes power shaft portion 60-3 disposed through an outer rotational member 70 that is rotationally secured with the outer housing 58. The power shaft portion 60-3 is rotationally connected to the upper BHA and drill string 14 to rotate in unison with the drill string 14 and the outer rotational member 70 rotates in unison with the outer housing 58, accordingly the power shaft portion 60-3 rotates at the surface rotational speed 5 and the outer rotational member 70 rotates at the drill bit rotational speed 7. The flow of drilling fluid through the cavities between the inner power shaft portion 60-3 and the outer rotational member 70 imparts rotation to the outer rotational member 70 and the connected outer housing 58 relative to the inner power shaft portion 60-3. The power shaft portion 60-3 may be referred to as a stator imparting relative rotation on the outer rotational member 70 which may be referred to as a rotor.

During drilling, the surface system 20 applies rotational speed 5 to the drill string 14 and the internal shaft member 60. High pressure drilling fluid 30 is pumped through the drill string 14 into the top end 62 of the inverted PDM 50-1 and flows in the direction 36 for example through bore 72 of the top drive shaft portion 60-1, through transmission section 56 into the cavities 74 of the power section 52 formed between the power shaft portion 60-3 and the outer rotational member 70. The pressure differential between adjacent cavities 74 forces the outer rotational member 70 to rotate relative to the inner shaft member 60 and impart rotational speed to the drill bit 18. The cavities 74 are formed between the spiral grooves in the outer rotational member 70 and spiral fins on the power shaft portion 60-3. The power shaft portion 60-3 may also move in the axial direction relative to the outer housing as the pressure drop along the power section changes. The transmission connection or shaft 60-2 may operate to absorb variation in the position of the power shaft portion.

Traditionally, positive displacement motors are arranged in the order from the power section at the top, with the outer housing connected to the upper BHA, and the bearing section at the bottom with the drive shaft connected to the drill bit. When used with a bent housing over the transmission section the PDM may be used alone for directional drilling, i.e. without a RSS. The closer the bent housing is to the drill bit the better the dogleg severity (DLS) capability, so it has always been attempted to place the transmission section and its bent housing as close to the drill bit as possible. In this manner the drive shaft of the bearing section sees the drill bit rotational speed. When a BHA is used for high DLS applications, the drive shaft is one of the weakest components and it can fail through fatigue. In accordance to aspects of this disclosure, the drive shaft 60-1 and transmission shaft 60-2 of the inverted PDM rotate at the slower rotational speed of the upper BHA, i.e. the surface rotational speed 5, rather than with the high speed of the drill bit, i.e., the drill bit rotational speed 7. This reduces the number of revolutions seen by the drive shaft 60-1 of the inverted PDM compared to a standard PDM and can even be zero if the BHA is "slide" from surface. This can significantly increase the reliability of the drive shaft for high DLS applications.

If a traditional positive displacement motor were simply inverted, the transmission shaft would be in tension rather than compression due to the axial force of the pressure drop over the power section. Certain transmission designs may need to be redesigned as they may only work in compression. The direction of the weight on the bit (WOB) and the axial pressure drop force across the power section are now also acting in the same direction rather than partially cancelling each other, so the maximum WOB allowable by the bearing section of an inverted standard PDM is reduced.

FIG. 3 illustrates an inverted drill motor 50 in the form of an inverted PDM 50-1 having two sets of bearing and transmission sections. The power section 52 is located between upper bearing section 54 and transmission section 56 and a lower bearing section 154 and lower transmission section 156. The internal shaft member 60, which rotates at the lower surface rotational speed 5, includes upper drive shaft 60-1, upper transmission shaft 60-2, power shaft portion 60-3, lower transmission shaft 160-2, and lower drive shaft 160-1. The upper bearing section 54 can carry the WOB through the outer housing 58 while the lower bearing section 154 can carry the axial force from the pressure drop over the power section 52. The upper transmission shaft 60-2 only has to convey torque and not axial force, while the lower transmission shaft 160-2 only needs to convey axial force.

FIG. 4 illustrates an inverted drill motor 50 in the form of an inverted PDM 50-1 in which an axial bearing 76 is utilized below the power section 52 in place of a lower transmission section and lower bearing section as illustrated in FIG. 3. Axial bearing 76 allows radial movement between the inner power shaft portion 60-3 of the power section 52 and the outer rotational member 70 for rotation relative to one another and facilitates carrying the axial force. For example, the radially compliant axial bearing 76 may comprise two diamond coated surfaces, for example, an interior surface 78 of the outer housing 58 and an outer surface 80 of a member 82 which may be connected for example with inner power shaft portion 60-3. Member 82 may include an interior bore 84 to convey drilling fluid as shown by arrow 36. The axial bearing 76 may comprise flow diverter 86 or be connected with the transmission section 56 through a flow diverter 86 to route the drilling fluid from the annular cavities between the inner power shaft portion 60-3 and the outer rotational member 70 into the bore 84. Accordingly, the drive shaft 60-1 and transmission shaft 60-2 rotate at the slower surface rotational speed 5 and the power section 52 imparts additional rotational speed to the outer housing 58 to rotate drill bit 18 at the drill bit rotational speed 7.

In FIGS. 2 to 4, the portion 88 of outer housing 58 that is disposed over the transmission sections 56, 156 is depicted as a straight housing as opposed to a bent housing (i.e., bent sub) as a steering device 46 is positioned below the inverted PDM 50-1 for steering. Steering device 46 may be one of a point-the-bit, push-the-bit, or hybrid system.

Figure 5:
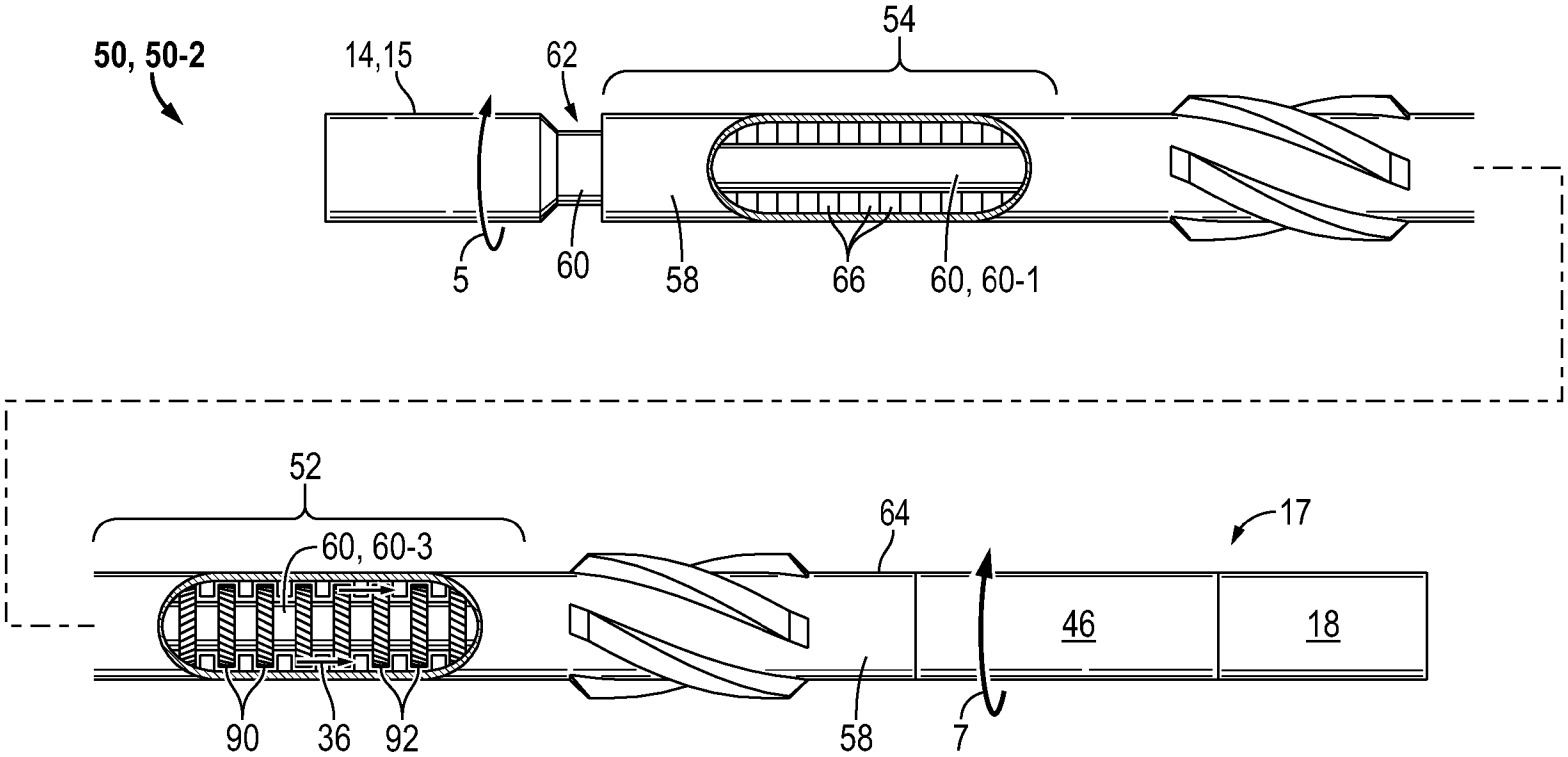
FIG. 5 illustrates an inverted drill motor in the form of an inverted turbodrill according to one or more aspects of the disclosure.

FIG. 5 illustrates an inverted drill motor 50 in the form of an inverted turbine drill motor or turbodrill 50-2. Inverted turbodrill 50-2 includes a power section 52 located at the bottom of the tool between the bearing section 54 and the drill bit 18. Unlike the positive displacement motors, the inverted turbodrill 50-2 does not have transmission section. The bottom end 64 of the outer housing 58 is connected to the drill bit 18 such that in operation the power section 52 rotates the outer housing 58 and the drill bit 18 at a rotational speed 7 that is greater than the rotational speed 5 of the drill string 14 in response to pumping drilling fluid 36 through the power section of the inverted turbodrill 50-2. The power section 52 of the inverted turbodrill 50-2 includes one or more turbine stages, each of the stages including one or more rotor disks 90 and one or stator disks 92. In FIG. 5 the rotor disks 90 are connected with the outer housing 58 so as to rotate in unison with the outer housing 58 relative to the internal shaft member 60. The stator disks 92 are connected with the internal shaft member 60, for example to the power shaft portion 60-3, to move in unison with the internal shaft member 60.

The internal shaft member 60 has a top drive shaft portion 60-1 that is rotatably mounted or secured in the outer housing 58 by bearings 66 in the bearing section 54. The top or initial end 62 of the internal shaft member 60 is connected to the upper BHA 15 such that the internal shaft 60 rotates at the surface rotation speed 5 of the drill string 14. With reference also to FIG. 1, drill string 14 may be formed for example of segmented pipe or coil tubing.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A bottom hole assembly (BHA), comprising:

an upper BHA comprising a drill string;

a lower BHA comprising a drill bit; and an inverted drill motor comprising an internal shaft member connected to the upper BHA to rotate in unison with the drill string at a surface rotational speed and an outer housing connected at a bottom end to the lower BHA to rotate in unison with the drill bit at a drill bit rotational speed, wherein the inverted drill motor imparts rotational speed to the drill bit, wherein the lower BHA comprises a rotary steering device.

2. The BHA of claim 1, wherein the inverted drill motor is an inverted positive displacement motor.

3. The BHA of claim 1, wherein the inverted drill motor is an inverted turbodrill.

4. The BHA of claim 1, wherein the internal shaft member comprises:

a top drive shaft having a top end connected to the upper BHA to rotate in unison with the drill string, the top drive shaft rotatably mounted in the outer housing;

a power shaft portion extending through an outer rotational member; and a transmission shaft connecting the top drive shaft to the power shaft portion.

5. The BHA of claim 4, further comprising an axial bearing in connection between the power shaft portion and the bottom end of the outer housing.

6. The BHA of claim 4, wherein the inverted drill motor comprises an axial bearing in connection between the power shaft portion and the bottom end of the outer housing, the axial bearing comprising two opposing rotatable bearing surfaces, wherein one of the rotatable bearing surfaces comprises diamond.

7. The BHA of claim 1, wherein the internal shaft member comprises:

a top drive shaft having a top end connected to the upper BHA to rotate in unison with the drill string, the top drive shaft rotatably mounted in the outer housing;

a power shaft portion extending through an outer rotational member;

an upper transmission shaft connecting the top drive shaft to the power shaft portion;

a lower drive shaft rotatably mounted in the outer housing proximate the bottom end; and a lower transmission shaft connecting the power shaft portion and the lower drive shaft.

8. An inverted positive displacement motor (PDM), comprising: an outer housing rotatable about a power shaft portion whereby rotational speed is imparted to the outer housing in response to fluid flow between the outer housing and the power shaft portion, the outer housing having a bottom end to connect to a drill bit whereby the outer housing and the drill bit rotate in unison; a top drive shaft having a top end to connect to a drill string, the top drive shaft rotatably secured within the outer housing by bearings; a transmission shaft connecting the top drive shaft and the power shaft portion; and a rotary steering device located between the bottom end of the outer housing and the drill bit.

9. The inverted PDM of claim 8, further comprising an axial bearing in connection between the power shaft portion and the bottom end of the outer housing.

10. The inverted PDM of claim 8, wherein the inverted PDM comprises an axial bearing in connection between the power shaft portion and the bottom end of the outer housing, the axial bearing comprising two opposing rotatable bearing surfaces, wherein one of the rotatable bearing surfaces comprises diamond.

11. The inverted PDM of claim 8, comprising a lower drive shaft rotatably secured in the outer housing proximate to the bottom end by bearings and a lower transmission shaft between the power shaft portion and the lower drive shaft.

12. A method, comprising:

utilizing an inverted drill motor deployed in wellbore on a drill string to impart a rotational speed to a drill bit, the inverted drill motor comprising an internal shaft member connected to the drill string to rotate with the drill string at a surface rotational speed and an outer housing rotatably mounted about the internal shaft member, the outer housing connected at a bottom end to the drill bit to rotate in unison at a drill bit rotational speed; and imparting the rotational speed to the outer housing and the drill bit in response to pumping drilling fluid through a power section of the inverted drill motor, whereby the drill bit rotational speed is greater than the surface rotational speed, wherein a rotary steering device is located between the drilling bit and the bottom end of the outer housing.

13. The method of claim 12, wherein the inverted drill motor is a turbodrill.

14. The method of claim 12, wherein the inverted drill motor is a positive displacement motor wherein the internal shaft member comprises a top drive shaft portion rotatably secured in the outer housing by bearings and connected at a top end to the drill string;

a power shaft portion of the internal shaft member extending through an outer rotational member connected to the outer housing; and a transmission shaft connecting the top drive shaft portion to the power shaft portion.

15. The method of claim 14, comprising an axial bearing in connection between the power shaft portion and the bottom end of the outer housing.

16. The method of claim 14, comprising a lower drive shaft rotatably secured in the outer housing proximate to the bottom end by bearings and a lower transmission connection between the power shaft portion and the lower drive shaft.

* * * * *